US006135759A

United States Patent [19]

Gerstenberger

[11] Patent Number: 6,135,759

[45] Date of Patent: Oct. 24, 2000

[54] VARIABLE-HEAT CHAFING-DISH BURNERS AND METHODS OF USE

[76] Inventor: Roland Gerstenberger, 4 Ocean West Blvd., #301C, Daytona Beach, Fla. 32118

[21] Appl. No.: 09/404,246

[22] Filed: Sep. 22, 1999

[51] Int. Cl.[7] ..... F23D 3/24

[52] U.S. Cl. ..... 431/12; 431/320; 431/322; 431/33; 431/315; 126/45

[58] Field of Search ..... 431/12, 320, 315, 431/329, 328, 327, 322, 298, 282, 278, 295, 33; 126/146, 46, 45, 48, 44, 43, 152

[56] References Cited

U.S. PATENT DOCUMENTS

| | | | |
|---|---|---|---|
| 344,587 | 6/1886 | Mauerman | 431/152 |
| D. 383,645 | 9/1997 | Hoffman . | |
| D. 405,315 | 2/1999 | Lioi . | |
| 525,170 | 8/1894 | Wattles | 126/43 |
| 802,662 | 10/1905 | Savage et al. . | |
| 939,121 | 11/1909 | Braaten | 431/282 |
| 973,713 | 10/1910 | Shaffer | 431/282 |
| 990,520 | 4/1911 | Boothe | 431/329 |
| 1,063,936 | 6/1913 | Schneider | 431/282 |
| 1,229,078 | 6/1917 | Herzog | 431/329 |
| 1,701,727 | 2/1929 | Phillips . | |
| 1,813,715 | 7/1931 | Summer . | |
| 2,219,170 | 10/1940 | Bailey | 126/45 |
| 2,800,174 | 7/1957 | Kondstandt . | |
| 3,361,126 | 1/1968 | Bloomfield | 126/43 |
| 3,606,609 | 9/1971 | Lipper et al. . | |
| 5,012,791 | 5/1991 | McCabe . | |
| 5,302,114 | 4/1994 | Kiefer et al. . | |
| 5,405,262 | 4/1995 | Appel . | |
| 5,797,739 | 8/1998 | Lioi . | |
| 5,829,966 | 11/1998 | Stoner . | |

*Primary Examiner*—Carl D. Price
*Attorney, Agent, or Firm*—Paul S. Rooy

[57] ABSTRACT

Variable-heat chafing-dish burners and methods of use. One variable-heat chafing-dish burner embodiment has a reservoir with liquid fuel, into which a short wick and a long wick extend. Both wicks are lit initially, in order to provide initial high heat to bring chafing-dish water quickly to temperature. As fuel is consumed by the flames fed by both wicks, the fuel level within the reservoir drops. The short wick initial immersed length is set such that at the approximate time the chafing-dish water has been brought to temperature, the short wick is no longer immersed in fuel, and the flame it fed is extinguished due to fuel starvation. After the flame fed by the short wick is extinguished, only the flame fed by the long wick remains lit, thereby providing the lowered heat required to maintain the chafing-dish water at temperature. In this manner, a high initial heat is provided to bring chafing-dish water quickly to temperature, and lower heat is provided thereafter to save fuel. Alternate variable-heat chafing-dish burner embodiments are disclosed which provide different configuration snuffers, such as a hinged flame-snuffer and a rotating flame-snuffer, whereby one of two long wicks may be quickly and easily extinguished. Using these embodiments, the operator initially lights both long wicks, and then uses the provided snuffer to extinguish one flame when the chafing-dish water has been brought to temperature, thus leaving only one flame burning to maintain temperature. An additional embodiment is disclosed which provides a chafing dish with two long wicks, and caps sealing the wicks for transportation and storage, and a seal over a neck surrounding the wicks. In operation, a conventional snuffer or other handy implement may be used to extinguish a flame fed by one long wick, in order to provide reduced heat following the initial high heat supplied by flames fed by both long wicks.

20 Claims, 4 Drawing Sheets

FIG 7
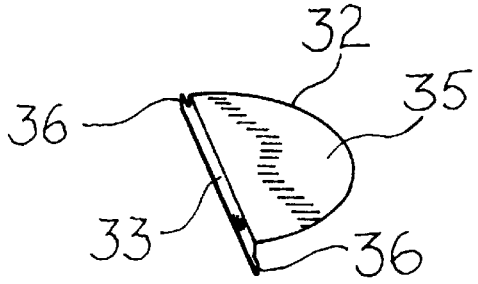
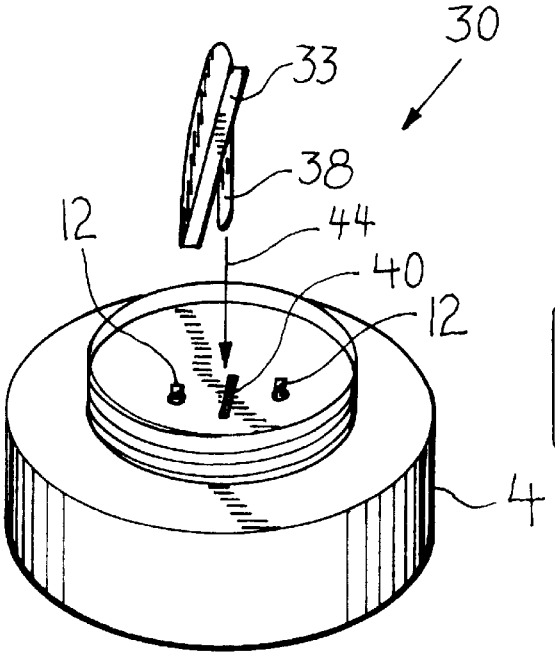
FIG 8
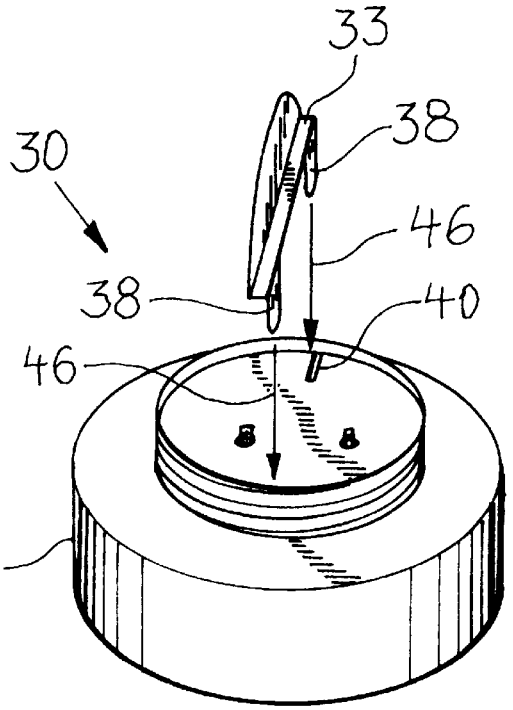
FIG 9

VARIABLE-HEAT CHAFING-DISH BURNERS AND METHODS OF USE

BACKGROUND OF THE INVENTION

1. Field of the Invention

This invention relates to food warmers, and in particular to variable-heat chafing-dish burners and methods of use.

2. Background of the Invention

It is uncertain when or how human beings first started to cook. Although prehistoric man discovered how to make fire ca. 500,000 B.C., and probably used same to heat food over small open fires, it is probable that naturally occurring fire was used for that purpose even before then.

Ancient Egyptians used mainly open fires for cooking, and also baked bread in earthen ovens, using wood and its byproduct, charcoal, as fuel. Romans used elevated brick fireplaces, over which iron kettles were suspended by tripods.

By the time the Middle Ages rolled around, most European people cooked in fireplaces, using iron kettles to heat liquids and pointed metal rods called spits to cook meat. Because many houses did not have a built-in oven, communal ovens and shared fireplaces were a common occurrence during this time period.

In the new world, North Americans cooked food using methods which were similar to those employed in Europe: fireplaces, heating kettles and meat on spits. In South America, gratings-like parillas were used to support meat (such as lamb) cooked outside over open fires. Large spits bearing cross-members supported entire animals, which were broiled whole around large bonfires called asados.

The 1800s saw the advent of iron cookstoves, the first practical exemple of which was patented in the United States in 1833. These stoves burned coal, and were more practical and convenient than wood-burning fireplaces.

The twentieth century has seen dramatic advances in cooking technology, including gas and electric stoves and ovens, microwave and convection ovens, pressure cookers, etc. One important advance has been the development of the modern chafing dish, which uses a burner to heat a water-filled pan. The heated water in turn heats a pan which contains the food itself. This form of food warming has made possible the modern hot food buffet, which features a variety of warm food maintained at temperature in a series of chafing dishes.

A major technological advance in and of itself which has made the chafing dish a reality is the chafing-dish burner. Chafing-dish burners typically use either a liquid fuel such as diethylene glycol ("DEG") or a solid fuel such as Stern®.

When chafing dishes are used in hot-food buffet arrangements, the buffet is set up by filling the chafing dishes with water to the appropriate extent, positioning the chafing-dish burners under the chafing dishes, and heating the water to the correct temperature (typically in the 180° F.–200° F. range). At some point during the water heating process, the pans of food are placed in contact with the heated water, so as to heat, and maintain heated, the food which is in them.

The most time-consuming event in the whole process is heating the water. This step generally takes one to two hours. In the case of caterers setting up a buffet at a field location, this means the caterers must appear on location an hour or two before starting to serve food, merely to heat water! Thus, a major disadvantage with currently available fixed-heat chafing-dish burners is the long time period required to heat the chafing-dish water, along with the associated cost of tying up personnel to accomplish this task.

Existing Designs

A number of designs have been proposed to provide a variable-heat chafing-dish burner capable of delivering high heat during the water-heating step, and reduced heat thereafter, when only enough heat to maintain food temperature is required.

One approach has been a solid-fuel can with two lids: a small central circular lid, and a larger annular lid surrounding the smaller central lid. The idea here is the small central lid may be removed first in order to provide a smaller flame, with associated reduced heat, and at a later time the larger annular lid may be removed to provide a larger flame, with associated increased heat. This design suffered from a number of drawbacks. First, it required the use of a solid fuel such as Sterno®, which costs at least 80% more than a liquid fuel such as DEG. Additionally, conventional Sterno® chafing-dish burners last only approximately 2½ hours, as opposed to around six hours in the case of liquid-fuel burners. Second, it would be difficult or impossible, and certainly hazardous to an individual attempting it, to reduce the flame size by re-installing the larger annular lid. The reason is that the cans within which the solid fuel is burning become very hot after a small period of time. An individual attempting to hold such a can in order to re-install the annular lid would burn his fingers in short order. In addition, the currently available solid fuel is solid only when cool: once burning, the solid fuel liquefies. Thus, if an individual had the extreme misfortune of upsetting the solid-fuel can, the liquefied solid fuel could spill out, sending a sheet of burning liquid fuel across the serving table. Needless to say, the damage and injury attending such an event could be substantial.

Another approach for regulating the size (and therefore the heat) of a chafing-dish solid-fuel burner flame was proposed by McCabe in U.S. Pat. No. 5,012,791. The '791 device proposed a flame cover comprising a variable-size window, actuatable by means of a metal slide. While the McCabe slide when cool appeared to be capable of enlarging and diminishing the window through which the solid fuel flame burned, it suffered from the same disadvantages as the central lid/annular lid arrangement described supra. First, relatively expensive solid fuel had to be used. Second, after a short burning period, the slide would become as hot as the solid fuel can itself, and thus become untouchable by bare hand. Therefore, it appeared two pairs of pliers would be required to operate the '791 device, which would be exceedingly inconvenient. Finally, an uncoordinated operator ran the risk of spilling the burning liquefied solid fuel, with potentially disastrous results as described above. An additional drawback inherent in the '791 design was its complexity, and thus its associated high relative cost.

Finally, U.S. Pat. No. 5,405,262 was granted Appel for an Adjustable Burning Canned Heating Apparatus. Although the Appel apparatus taught the use of a liquid fuel, it unfortunately suffered from most the other disadvantages associated with the '791 device: impossibility or difficulty of changing the flame size while hot, complexity, and high cost.

SUMMARY OF THE INVENTION

Accordingly, it is an object of the present invention to provide variable-heat chafing-dish burners and methods of use which provide high heat for a first period of time, and lower heat thereafter. Design features allowing this object to be accomplished include a reservoir containing fuel, and in a preferred embodiment, a long wick and a short wick; in a first and third alternate embodiments a moveable flame-snuffer in combination with two long wicks; and in a second alternate embodiment a pair of long wicks and means to extinguish a flame fed by one. Advantages associated with the accomplishment of this object include the ability to quickly heat chafing-dish water under high heat, and then to be able to reduce the heat supplied by the variable-heat chafing-dish burner to a level required to maintain food hot, along with the associated time and cost savings.

It is another object of the present invention to provide variable-heat chafing-dish burners which are fueled by a liquid fuel. Design features allowing this object to be accomplished include the use of a liquid-fuel reservoir and wicks. Benefits associated with the accomplishment of this object include decreased fuel cost, and a cooler burner, along with the associated safety results.

It is still another object of this invention to provide variable-heat chafing-dish burners and methods of use which afford easy operation. Design features enabling the accomplishment of this object include a fuel reservoir from which are fueled a long wick and a short wick. Advantages associated with the realization of this object include minimal attention from the operator, and automatic operation wherein the shorter wick self-extinguishes after a predetermined time period, thus freeing cooking personnel to perform other tasks, thereby saving time and money.

It is still another object of this invention to provide variable-heat chafing-dish burners and methods of use whose heat output may easily be changed from high heat to lower heat, and vice-versa. Design features enabling the accomplishment of this object include a reservoir containing fuel; in a first and third alternate embodiment a moveable flame-snuffer in combination with two long wicks; and in a second alternate embodiment a pair of long wicks and means to extinguish a flame fed by one of them. In addition, the instant variable-heat chafing-dish burner is fueled by liquid fuel, which provides greatly reduced burn risk to an individual handling the burner. Advantages associated with the realization of this object include ease of operation, time-saving, and increased operator safety. Another advantage is the ability to decrease and increase heat delivered by the instant burner at will, which yields the operator unprecedented flexibility in meeting the requirements of a particular situation: the heat required will differ depending on whether the buffet is inside or outside, the type of food being cooked (different foods require different temperatures), etc.

It is still another object of this invention to provide variable-heat chafing-dish burners and methods of use which save fuel. Design features enabling the accomplishment of this object include the capability to first deliver high heat, then to deliver lower heat. Advantages associated with the realization of this object include reduced cost, and achievement of the environmental objective of reduced consumption of a finite resource. Fuel is saved because during the initial water heating step, the items being heated by the variable-heat chafing-dish burner are exposed to the ambient for less time than with conventional chafing-dish burners, thus reducing convective heat loss, which reduces the fuel required. For example, if the instant variable-heat chafing-dish burner heats chafing-dish water to 190° F. in one hour, as compared to two hours with a conventional chafing-dish burner, the instant variable-heat chafing-dish burner avoids the additional hour of convective heat loss from the items being heated, thus saving fuel.

It is another object of the present invention to provide a variable-heat chafing-dish burner which is inexpensive. Design features allowing this object to be accomplished include, in the preferred embodiment, a fuel reservoir containing liquid fuel, a lid, and a pair of wicks. Benefits associated with the accomplishment of this object include reduced cost, and hence increased availability.

BRIEF DESCRIPTION OF THE DRAWINGS

The invention, together with the other objects, features, aspects and advantages thereof will be more clearly understood from the following in conjunction with the accompanying drawings.

Four sheets of drawings are provided. Sheet one contains FIGS. 1, 2 and 3. Sheet two contains FIGS. 4, 5 and 6. Sheet three contains FIGS. 7, 8 and 9. Sheet four contains FIGS. 10, 11 and 12.

FIG. 7 is a side isometric view of a hinged flame-snuffer.

FIG. 8 is a side isometric view of a first alternate embodiment variable-heat chafing-dish burner whose hinged flame-snuffer comprises a hinged flame-snuffer tab.

FIG. 9 is a side isometric view of a first alternate embodiment variable-heat chafing-dish burner whose hinged flame-snuffer comprises a pair of hinged flame-snuffer tabs.

DETAILED DESCRIPTION OF THE PREFERRED EMBODIMENT

Figure 1:
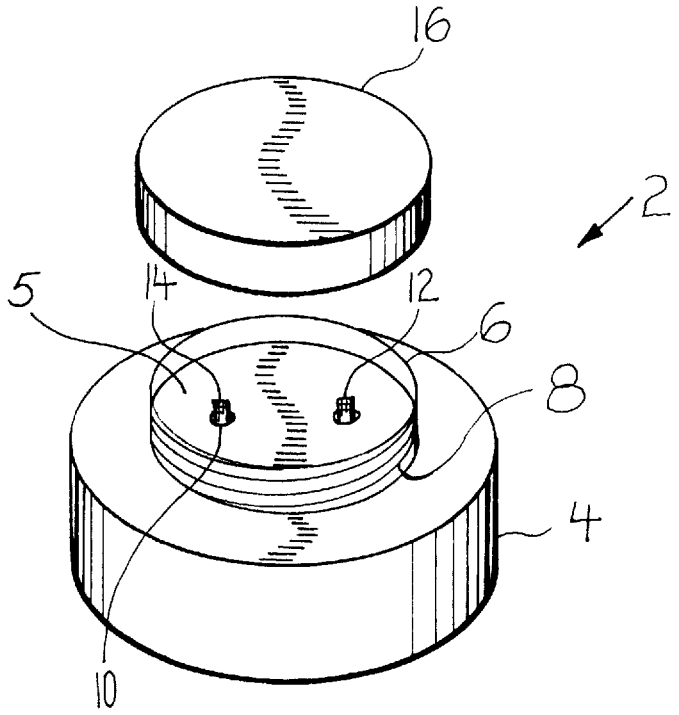
FIG. 1 is a front isometric view of a variable-heat chafing-dish burner.

FIG. 1 is a front isometric view of variable-heat chafing-dish burner 2. Variable-heat chafing-dish burner 2 comprises reservoir 4 containing liquid fuel 20, and neck 6 having neck thread 8 onto which lid 16 threads. Long wick 12 and short wick 14 each extend from reservoir 4 through awick aperture 10.

Figure 2:
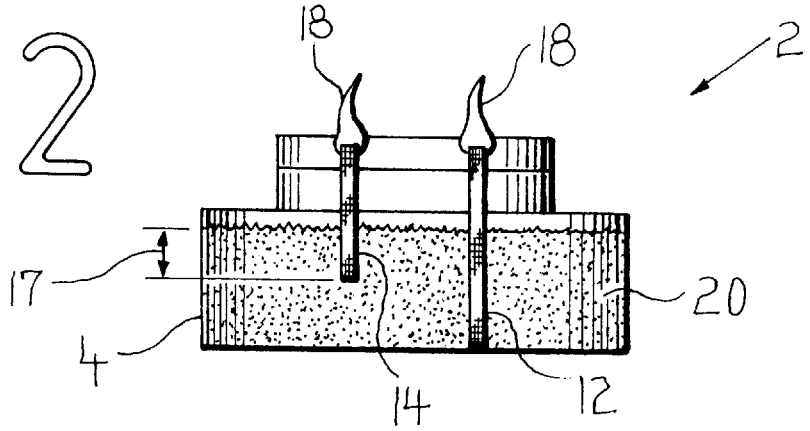
FIG. 2 is a side cross-sectional view of a variable-heat chafing-dish burner showing both wicks feeding a flame.
Figure 3:
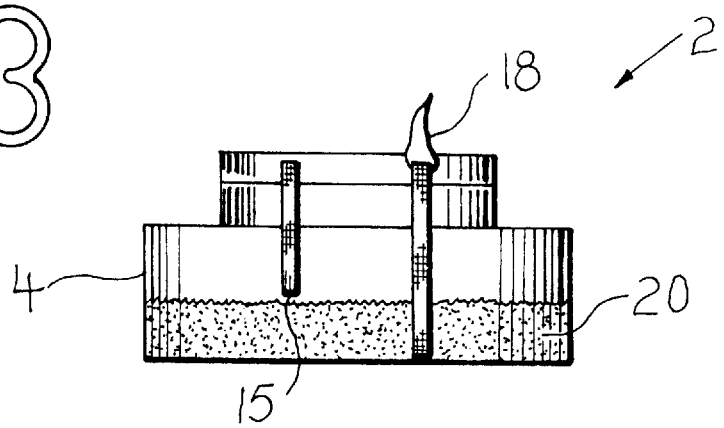
FIG. 3 is a side cross-sectional view of a variable-heat chafing-dish burner showing the shorter wick no longer feeding its flame because the fuel level has dropped below its lower extreme.

FIG. 2 is a side cross-sectional view of variable-heat chafing-dish burner 2 showing both long wick 12 and short wick 14 each feeding a flame 18. FIG. 3 is a side cross-sectional view of variable-heat chafing-dish burner 2 showing short wick 14 no longer feeding its flame 18 because the level of fuel 20 has dropped below short wick lower extreme 15. As flames 18 burn, the level of fuel 20 drops within reservoir 4 because fuel 20 is consumed feeding flames 18. Thus, depending on the short wick initial immersed length 17, the length of time passing before its flame 18 extinguishes from fuel 20 starvation can be accurately set. Therefore, by initially lighting both short wick 14 and long wick 12, the amount of time that both are feeding flames 18 can be accurately set. After the flame fed by short wick 14 extinguishes because the level of fuel 20 has dropped below short wick lower extreme 15, only the flame fed by long wick 12 continues burning.

In practice, conventional liquid fuel chafing-dish burners contain enough fuel to burn approximately six hours. The first 1–2 hours are currently spent warming the chafing-dish water, leaving 4–5 hours serving time.

The instant variable-heat chafing-dish burner 2 initially provides twice the heat output of conventional variable-heat chafing-dish burners, because two wicks are burning simultaneously. During this initial, high heat phase, the chafing-dish water will be heated to temperature in less than half the time required by a conventional, single-wick chafing-dish burner, because the amount of time the chafing dish is exposed to convective heat loss to the ambient is cut in half Thus the total heat required to bring the chafing-dish water to temperature (be it measured in calories, BTUs, or whatever heat unit) is reduced by approximately half the conventional heating time's worth of convective heat loss to ambient, because the instant invention heating operation takes only about half the conventional time.

The instant variable-heat chafing-dish burner 2 and method of use may be used to obtain any combination of initial and serving heating times, by setting short wick initial immersed length 17 appropriately. For example, it may be desired to provide high initial heat for ½ hour, followed by 5 hours of lower heat. This result may be easily and simply obtained by setting the short wick initial immersed length 17 such that fuel 20 drops below short wick lower extreme 15 after ½ hour, thus extinguishing the flame 18 fed by short wick 14 after ½ hour and leaving only the flame 18 fed by long wick 12 burning for the remaining 5 hours of fuel 20 available.

Under a different scenario, it may be desired to provide high initial heat for 1 hour, followed by 4 hours of lower heat. This result may be easily and simply obtained by setting the short wick initial immersed length 17 such that fuel 20 drops below short wick lower extreme 15 after 1 hour, thus extinguishing the flame 18 fed by short wick 14 after 1 hour and leaving only the flame 18 fed by long wick 12 burning for the remaining 4 hours of fuel 20 available. In this fashion, by means of the instant variable-heat chafing-dish burner 2 and the method of use described above, the initial chafing water heating time may be reduced by more than 50%, and corresponding personnel time and fuel saved.

In the appended claims, these initial heating times will be claimed as 1 hour±15 minutes and 30 minutes±10 minutes, in order to permit generous manufacturing tolerances, as well as to not unduly limit the scope of the claims in question. In practice, however, it is anticipated that manufacturing tolerances will be held tighter than these.

Figure 4:
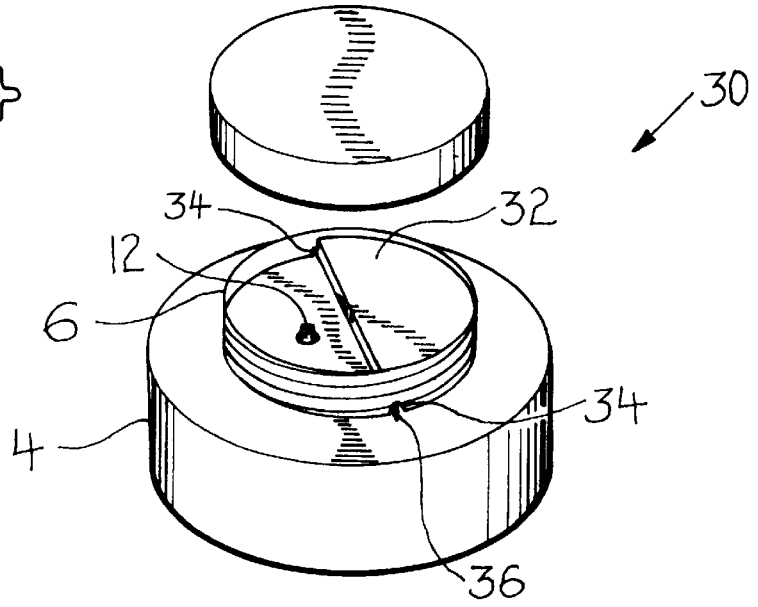
FIG. 4 is a side isometric view of a first alternate embodiment variable-heat chafing-dish burner having a hinged flame-snuffer.

FIG. 4 is a side isometric view of first alternate embodiment variable-heat chafing-dish burner 30 having hinged flame-snuffer 32 in the closed, or "snuffing" position. FIG. 7 is a side isometric view of hinged flame-snuffer 32. Hinged flame-snuffer 32 comprises hinged flame-snuffer base 33 rigidly attached to snuffer 35, and a pair of hinged flame-snuffer pins 36 attached to opposite extremes of hinged flame-snuffer base 33. In the preferred embodiment, hinged flame-snuffer base 33 was rigidly attached to snuffer 35 at a substantially right angle, but in practice any appropriate angle could be used. Hinged flame-snuffer 32 is hingedly attached to reservoir 4 by means of hinged flame-snuffer pins 36 extending through neck apertures 34. First alternate embodiment variable-heat chafing-dish burner 30 comprises two long wicks 12, each capable of feeding a flame 18 so long as fuel 20 remains in reservoir 4.

Figure 5:
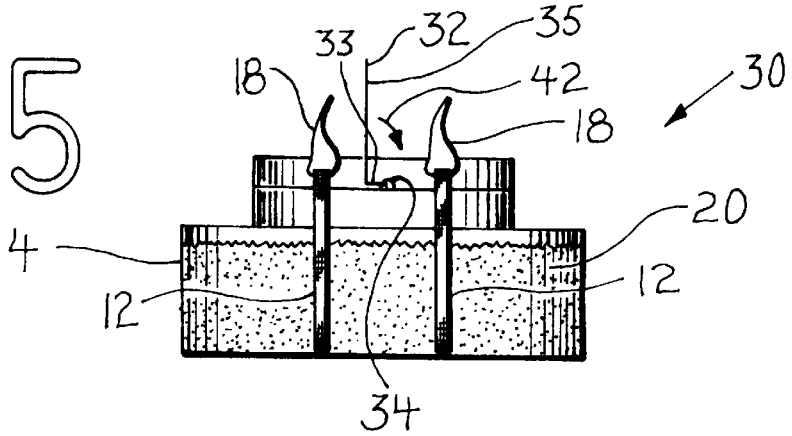
FIG. 5 is a side cross-sectional view of a first alternate embodiment variable-heat chafing-dish buner with both wicks feeding a flame, and the hinged flame-snuffer in the "non-snuffing" position.
Figure 6:
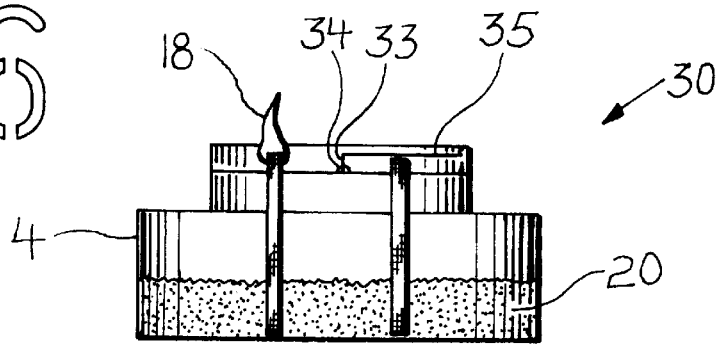
FIG. 6 is a side cross-sectional view of a first alternate embodiment variable-heat chafing-dish burner with one of its wicks extinguished by the hinged flame-snuffer; the hinged flame-snuffer is in the "snuffing" position.

FIG. 5 is a side cross-sectional view of first alternate embodiment variable-heat chafing-dish burner 30 with each long wick 12 feeding a flame 18. Hinged flame-snuffer 32 is in the upright, or "non-snuffing" position. Hinged flame-snuffer base 33 abuts against the top of reservoir 4, thus maintaining snuffer 35 substantially perpendicular to the top of reservoir 4, and permitting flames fed by both long wicks 12 to burn. In its closed or "snuffing" position as depicted in FIGS. 4 and 6, hinged flame-snuffer base 33 offsets snuffer 35 above the top of reservoir 4, thus permitting a tight fit between neck 6 and snuffer 35. It is contemplated to be within the scope of the invention, however, to use different shapes for hinged flame-snuffer 32. For example, if a curved cross-sectional shape snuffer 35 is employed, then hinged flame-snuffer base 33 may be eliminated completely, and a frictional fit between hinged flame-snuffer pins 36 and neck apertures 34 could maintain snuffer 35 in any position desired, either "snuffing" or "non-snuffing". A side benefit of positioning hinged flame-snuffer 32 in the "non-snuffing" position depicted in FIG. 5 is that it acts as a windshield, thus protecting flames 18 from being extinguished by wind.

The configuration depicted in FIG. 5 is used for the initial, high heat phase of heating the chafing-dish water, and the objective in this phase is to deliver high heat in order to heat the chafing-dish water in as short a time as possible. When the water has reach the desired temperature, hinged flame-snuffer 32 is simply folded down as depicted by arrow 42 over one of the flames 18 into the "snuffing" position depicted in FIGS. 4 and 6. The flame 18 over which hinged flame-snuffer 32 is folded is extinguished, and only the remaining flame 18 burns, thus providing the lower heat required to maintain the chafing-dish water at temperature. Of course, if increased heat is desired, the unused long wick 12 may be re-lit at any time, and just as easily extinguished again if reduced heat is subsequently indicated.

It should be noted that hinged flame-snuffer 32 can be quickly and easily folded into the closed position. The operator doesn't even have to touch hinged flame-snuffer 32: a utensil can be easily used as a prod to close hinged flame-snuffer 32 into the "snuffing" position. Thus, the danger of spillage and personal burn injury is greatly reduced by means of the instant apparatus and methods.

FIG. 8 is a side isometric view of first alternate embodiment variable-heat chafing-dish burner 30 hingedly attached to reservoir 4 by means of a hinged flame-snuffer tab 38 sized to fit into a reservoir slot 40 as indicated by arrow 44. Hinged flame-snuffer tab 38 is rigidly attached to hinged flame-snuffer base 33.

FIG. 9 is a side isometric view of first alternate embodiment variable-heat chafing-dish burner 30 hingedly attached to reservoir 4 by means of a pair of hinged flame-snuffer tabs 38, each sized to fit into a reservoir slot 40 as indicated by arrows 46. Hinged flame-snuffer tabs 38 are rigidly attached to hinged flame-snuffer base 33.

Figure 11:
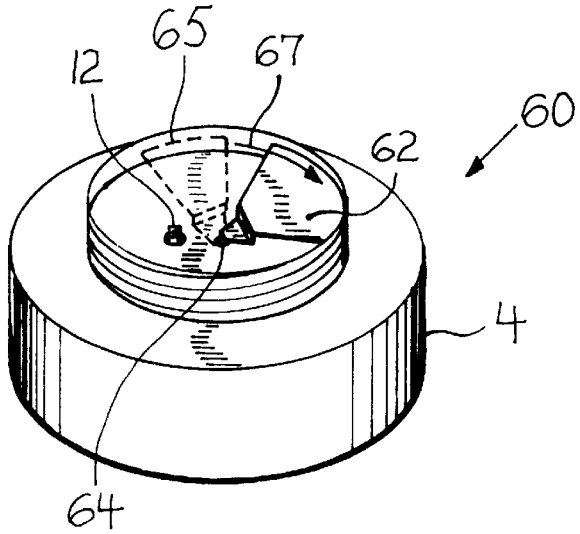
FIG. 11 is a side isometric view of a third alternate embodiment variable-heat chafing-dish burner having a rotating flame-snuffer.

FIG. 11 is a side isometric view of third alternate embodiment variable-heat chafing-dish burner 60 comprising reservoir 4, rotating flame-snuffer 62, and two long wicks 12. One long wick 12 is visible; the other is being snuffed by rotating flame-snuffer 62 and is thus obscured.

Figure 12:
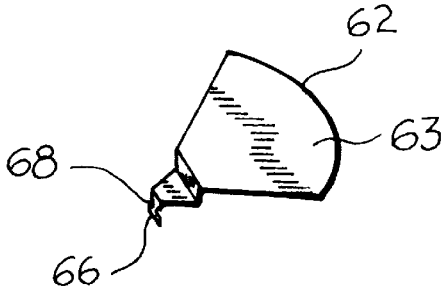
FIG. 12 is a side isometric view of a rotating flame-snuffer.

FIG. 12 is a side isometric view of rotating flame-snuffer 62. Rotating flame-snuffer 62 comprises rotating flame-snuffer tab 66 rigidly attached to snuffer 63. Rotating flame-snuffer 62 is rotatably attached to reservoir 4 by means of rotating flame-snuffer tab 66 extending into reservoir aperture 64. In the preferred embodiment, rotating flame-snuffer tab 66 comprises rotating flame-snuffer tab-width reduction 68 which prevents rotating flame-snuffer tab 66 from translating lengthwise relative to reservoir aperture 64: that is to say, reservoir aperture 64 is sized to frictionally admit rotating flame-snuffer tab 66, and to permit rotating flame-snuffer tab-width reduction 68 to rotate freely within reservoir aperture 64.

Third alternate embodiment variable-heat chafing-dish burner 60 operates in much the same manner as second alternate embodiment variable-heat chafing-dish burner 30 as described above. Both long wicks 12 are initially lit, with rotating flame-snuffer 62 rotated into the "non-snuffing" position depicted by ghost lines 65 in FIG. 11. After the chafing-dish water is heated to temperature, rotating flame-snuffer 62 is rotated as indicated by arrow 67 until its snuffer 63 completely covers one long wick 12, extinguishing it. Thereafter, the remaining long wick 12 feeds its flame 18 in order to provide reduced heat. Of course, if increased heat is desired, the unused long wick 12 may be re-lit at any time, and just as easily extinguished again if reduced heat is indicated.

Figure 10:
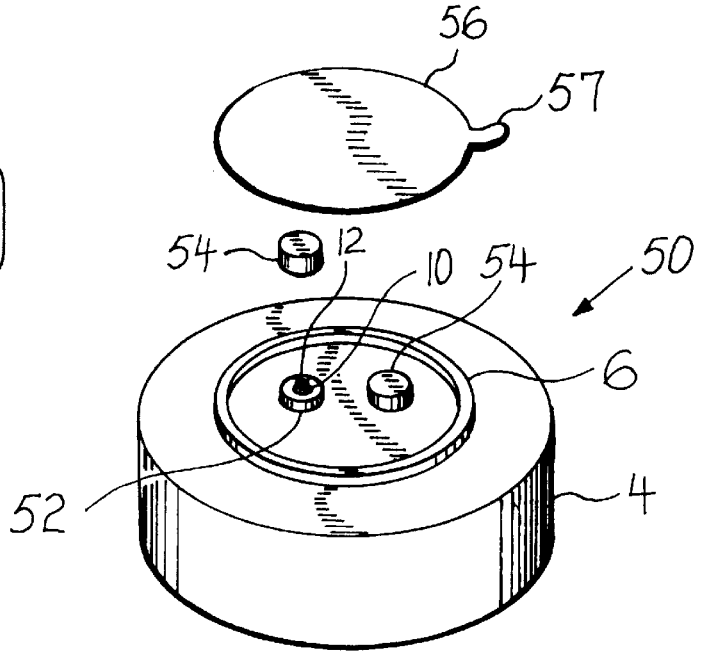
FIG. 10 is a side isometric view of a second alternate embodiment variable-heat chafing-dish burner comprising a pair of long wicks.

As in first alternate embodiment variable-heat chafing-dish burner 30 described above, it should be noted that rotating flame-snuffer 62 can be quickly and easily rotated into the closed position. The operator doesn't even have to touch rotating flame-snuffer 62: a utensil can be easily used as a prod to rotate rotating flame-snuffer 62 into the "snuffing" position. Thus, the danger of spillage and personal burn injury is greatly reduced by means of the instant apparatus and methods FIG. 10 is a side isometric view of second alternate embodiment variable-heat chafing-dish burner 50 comprising reservoir 4 and a pair of long wicks 12. Each long wick 12 emerges from reservoir 4 through a wick aperture 10. Each wick aperture 10 is surrounded by a wick base 52.

During shipping and storage, each wick base 52 is covered by a cap 54, and neck 6 is covered by seal 56, to prevent leakage of liquid fuel 20 during shipping and/or storage. Seal 56 is removably attached to neck 6 for shipping and storage, and may be easily removed by pulling up on seal tab 57 when second alternate embodiment variable-heat chafing-dish burner 50 is to be used.

Second alternate embodiment variable-heat chafing-dish burner 50 is prepared for use by removing seal 56 from neck 6, and by removing caps 54 from their respective wick bases 52. Both long wicks 12 are lit, and after the chafing-dish water is brought to temperature, the flame 18 fed by one long wick 12 is extinguished. For instance, a conventional cone-shaped candle snuffer may be used, or even the flat of a butter-knife blade, or a spoon. After one flame 18 has been extinguished, the remaining flame 18 remains burning in order to maintain water temperature. Of course, if increased heat is desired, the unused long wick 12 may be re-lit at any time, and just as easily extinguished again if reduced heat is subsequently indicated.

Reservoir 4, neck 6, hinged flame-snuffer 32, and rotating flame-snuffer 62 may be manufactured of aluminum, steel, synthetic, or other appropriate material. Long wicks 12 and short wicks 14 may be manufactured of appropriate wick material which exhibits the desired capillary action. Caps 52 may be made of metal, plastic, synthetic or other appropriate material. Seal 56 may be made of metal foil, plastic, coated cardboard, synthetic, or other appropriate material. Liquid fuel 20 my be an alcohol- or paraffin-based liquid fuel such as diethylene glycol, or any other appropriate liquid fuel.

While a preferred embodiment of the invention has been illustrated herein, it is to be understood that changes and variations may be made by those skilled in the art without departing from the spirit of the appending claims.

DRAWING ITEM INDEX

2 variable-heat chafing-dish burner
4 reservoir
5 reservoir top
6 neck
8 neck thread
10 wick aperture
12 long wick
14 short wick
15 short wick lower extreme
16 lid
17 short wick initial immersed length
18 flame
20 fuel
30 first alternate embodiment variable-heat chafing-dish burner
32 hinged flame-snuffer
33 hinged flame-snuffer base
34 neck aperture
35 snuffer
36 hinged flame-snuffer pin
38 hinged flame-snuffer tab
40 reservoir slot
42 arrow
44 arrow
46 arrow
50 second alternate embodiment variable-heat chafing-dish burner
52 wick base
54 cap
56 seal
57 seal tab
60 third alternate embodiment variable-heat chafing-dish burner
62 rotating flame-snuffer
63 snuffer
64 reservoir aperture
65 ghost lines
66 rotating flame-snuffer tab
67 arrow
68 rotating flame-snuffer tab-width reduction

I claim:

1. A method of use for a variable-heat chafing-dish burner, said variable-heat chafing-dish burner comprising a reservoir having a reservoir top, a pair of wick apertures disposed in said reservoir top, a long wick extending through one said wick aperture, and a short wick extending through the other said wick aperture, a position of said wicks being fixed relative to said reservoir top, said long wick extending above said reservoir top a distance substantially equal to a distance said short wick extends above said reservoir top, a cross-sectional area of said long wick being substantially equal to a cross-sectional area of said short wick, said wicks being spaced sufficiently apart that a flame of one said wick will not readily ignite the other said wick, so that said wicks may operate independently of each other, said short wick extending into an interior of said reservoir a distance less than said long wick extends into said interior of said reservoir lengths of said wicks having been pre-determined whereby said short wick will burn for a fixed period of time and then extinguish due to fuel starvation, and said long wick will thereafter remain burning for a period of time, said long wick extending into fuel disposed within said reservoir sufficiently to access all said fuel, and said short wick extending into said fuel a distance equal to a short wick initial immersed length when said reservoir is filled to capacity with said fuel, said method comprising the steps of:

A. Setting said short wick initial immersed length to a length which will yield a desired burn time for a flame fed by said short wick;

B. Lighting said short wick and said long wick;

C. Permitting said flame fed by said short wick to extinguish when a level of said fuel drops below said short wick initial immersed length, due to fuel consumption of the flames fed by said short wick and said long wick; and D. Continuing heating solely by means of the flame fed by said long wick.

2. The method of use for a variable-heat chafing-dish burner of claim 1 wherein said desired burn time for a flame fed by said short wick is 30 minutes±10 minutes.

3. The method of use for a variable-heat chafing-dish burner of claim 1 wherein said desired burn time for a flame fed by said short wick is 1 hou±15 minutes.

4. A method of use for a variable-heat chafing-dish burner, said variable-heat chafing-dish burner comprising a reservoir having a reservoir top, a pair of wick apertures disposed in said reservoir top, a long wick extending through each said wick aperture, a position of said wicks being fixed relative to said reservoir top, said long wicks extending substantially equal distances above said reservoir top, cross-sectional areas of said long wicks being substantially equal, said wicks being spaced sufficiently apart that a flame of one said long wick will not readily ignite the other said lone wick, so that said long wicks may operate independently of each other, and a hinged flame-snuffer hingedly attached to said reservoir, said hinged flame-snuffer comprising a snuffer which covers one said long wick when said hinged flame-snuffer is an a snuffing position said snuffer covering neither said long wicks when said hinged flame-snuffer is an a non-snuffing position whereby a flame fed by one said long wicks may be quickly and easily extinguished, leaving only one said wick burning, said hinged flame snuffer further comprising a hinged flame snuffer base attached to said snuffer at a substantially right angle, said snuffer base resting on said reservoir top when said hinged flame snuffer is in said non-snuffing position, thus holding said snuffer in said non-snuffing position by virtue of said substantially right angle attachment between said snuffer and hinged flame snuffer base, said reservoir containing fuel, each said long wicks extending into said fuel sufficiently to access all said fuel, said method comprising the steps of:

A. Positioning said hinged flame snuffer in said non-snuffing position by placing said hinged flame snuffer base into contact with said reservoir top so as to allow the flames fed by both said long wicks to burn un-snuffed;

B. Lighting both said long wicks whereby a high initial heat is supplied to heat chafing-dish water, and C. Moving said hinged flame snuffer into said snuffing position by removing said hinged flame snuffer base from contact with said reservoir top sufficiently to extinguish the flame fed by one said long wick, thereby providing reduced heat required to maintain said chafing-dish water at temperature while simultaneously saving fuel which would have been consumed had the flame fed by one said long wick not been extinguished.

5. The method of use for a variable-heat chafing-dish burner of claim 4 comprising the further step of:

D. Re-positioning said means of quickly and easily extinguishing a flame fed by one said long wick so as to allow both said long wicks to feed a flame; and E. Re-lighting said extinguished long wick, whereby high heat may be supplied to said chafing dish.

6. A method of use for a variable-beat chafing-dish burner, said variable-heat chafing-dish burner comprising a reservoir having a reservoir top, a pair of wick apertures disposed in said reservoir top, a long wick extending through each said wick aperture, a position of said wicks being fixed relative to said reservoir top, said long wicks extending equal distances above said reservoir top, cross-sectional areas of said long wicks being substantially equal, said wicks being spaced sufficiently apart that a flame of one said long wick will not readily ignite the other said long wick, so that said long wicks may operate independently of each other, and a rotating flame-snuffer rotatably attached to said reservoir top, a motion of said rotating flame-snuffer being substantially constrained to a plane parallel to said reservoir top, said rotating flame-snuffer comprising a snuffer which covers one said long wick when said rotating flame-snuffer is an a snuffing position, said snuffer covering neither said long wicks when said rotating flame-snuffer is an a non-snuffing position, whereby a flame fed by one said long wicks may be quickly and easily extinguished, leaving only one said wick burning, said reservoir containing fuel, each said long wicks extending into said fuel sufficiently to access all said fuel, said method comprising the steps of:

A. Positioning said rotating flame snuffer in a position where it snuffs neither said wicks so as to allow flames fed by both said long wicks to burn un-snuffed;

B. Lighting both said long wicks whereby a high initial heat is supplied to heat chafing-dish water; and C. Moving said rotating flame snuffer into a snuffing position by rotating said rotating flame snuffer relative to said reservoir top to extinguish the flame fed by one said long wick, thereby providing reduced heat required to maintain said chafing-dish water at temperature while simultaneously saving fuel which would have been consumed had the flame fed by one said long wick not been extinguished.

7. The method of use for a variable-heat chafing-dish burner of claim 6 comprising the further step of:

D. Re-positioning said rotating flame snuffer so as to allow both said long wicks to feed a flame; and E. Re-lighting said extinguished long wick, whereby high heat may be supplied to said chafing dish.

8. A variable-heat chafing-dish buner comprising a reservoir having a reservoir top, a pair of wick apertures disposed in said reservoir top, a long wick extending through one said wick aperture, and a short wick extending through another said wick aperture, a position of said wicks being fixed relative to said reservoir top, said long wick extending above said reservoir top a distance substantially equal to a distance said short wick extends above said reservoir top, a cross-sectional area of said long wick being substantially equal to a cross-sectional area of said short wick said wicks being spaced sufficiently apart that a flame of one said wick will not readily ignite the other said wick, so that said wicks may operate independently of each other, said short wick extending into an interior of said reservoir a distance less than said long wick extends into said interior of said reservoir, lengths of said wicks having been pre-determined whereby said short wick will burn for a fixed period of time and then extinguish due to fuel starvation, and said long wick will thereafter remain burning for a period of time.

9. The variable-heat chafing-dish burner of claim 8 wherein said reservoir contains fuel, said long wick extends into said fuel sufficiently to access all said fuel, and said short wick extends into said fuel a distance equal to a short wick initial immersed length when said reservoir is filled to capacity with said fuel.

10. The variable-heat chafing-dish burner of claim 9 wherein said short wick initial immersed length is such that after 1 hour±15 minutes of burning of a flame fed by said short wick, a level of said fuel will descend below a lower extreme of said short wick due to fuel consumption, whereby a flame fed by said short wick will be extinguished due to fuel starvation.

11. The variable-heat chafing-dish burner of claim 9 wherein said short wick initial immersed length is such that after 30 minutes±10 minutes of burning of a flame fed by said short wick, a level of said fuel will descend below a lower extreme of said short wick due to fuel consumption, whereby a flame fed by said short wick will be extinguished due to fuel starvation.

12. The variable-heat chafing-dish burner of claim 9 further comprising a neck surrounding said short wick and said long wick, and a removable lid on said neck, whereby spillage of said fuel during transportation and storage may be avoided.

13. A variable-heat chafing-dish burner comprising a reservoir having a reservoir top, a pair of wick apertures disposed in said reservoir top, a long wick extending through each said wick aperture, a position of said wicks being fixed relative to said reservoir top, said long wicks extending substantially equal distances above said reservoir top, cross-sectional areas of said long wicks being substantially equal, said wicks being spaced sufficiently apart that a flame of one said long wick will not readily ignite the other said long wick, so that said long wicks may operate independently of each other, and a hinged flame-snuffer hingedly attached to said reservoir, said hinged flame-snuffer comprising a snuffer which covers once said long wick when said hinged flame-snuffer is in a snuffing position, said snuff covering neither said long wicks when said hinged flame-snuffer is in a non-snuffing position, whereby a flame fed by one said long wick may be quickly and easily extinguished, leaving only one said wick burning, said hinged flame snuffer further comprising a hinged flame snuffer base attached to said snuffer at a substantially right angle, said snuffer base resting on said reservoir top when said hinged fame snuffer is in said non-snuffing position, thus holding said snuffer in said non-snuffing position by virtue of said substantially right angle attachment between said snuffer and said hinged flame snuffer base.

14. The variable-heat chafing-dish burner of claim 6 wherein said burner further comprises a neck around said long wicks, and wherein said hinged flame-snuffer further comprises a pair of hinged flame-snuffer pins rigidly attached to said hinged flame snuffer base, each said hinged flame-snuffer pin being rotatably disposed within a neck aperture in said neck.

15. The variable-heat chafing-dish burner of claim 13 wherein said hinged flame-snuffer comprises at least one hinged flame-snuffer tab rigidly attached to said snuffer, and said reservoir comprises a reservoir slot corresponding to each said at least one hinged flame-snuffer tab, each said reservoir slot being sized to admit its corresponding hinged flame-snuffer tab, whereby said hinged flame-snuffer is hingedly attached to said reservoir.

16. The variable-heat chafing-dish burner of claim 13 further comprising a wick base surrounding each said wick aperture, and a cap removably mounted on each said wick base, whereby spillage of fuel contained within said reservoir may be prevented during transportation and storage.

17. The variable-heat chafing-dish burner of claim 16 further comprising a neck surrounding said wicks, and a seal removably mounted to said neck, whereby spillage of said fuel contained within said reservoir may be prevented during transportation and storage.

18. A variable-heat chafing-dish burner comprising a reservoir having a reservoir top, a pair of wick apertures disposed in said reservoir top, a long wick extending through each said wick aperture, a position of said wicks being fixed relative to said reservoir top, said long wicks extending equal distances above said reservoir top, cross-sectional areas of said long wicks being substantially equal, said wicks being spaced sufficiently apart that a flame of one said long wick will not readily ignite the other said long wick, so that said long wicks may operate independently of each other, and a rotating flame-snuffer rotatably attached to said reservoir top, a motion of said rotating flame-snuffer b substantially constrained to a plane parallel to said reservoir top, said rotating flame-snuffer comprising a snuffer which covers one said long wick when said rotating flame-snuffer is in a snuffing position, said snuffer covering neither said long wicks when said rotating flame-snuffer is an a non-snuffing position, whereby a flame fed by one said long wicks may be quickly and easily extinguished, leaving only one said wick burning.

19. The variable-heat chafing-dish burner of claim 18 wherein said rotating flame-snuffer comprises a rotating flame-snuffer tab rigidly attached to said snuffer, and wherein said reservoir to further comprises a reservoir aperture, whereby said rotating flame-snuffer is rotatably attached to said reservoir top.

20. The variable-heat chafing-dish burner of claim 19 wherein said rotating flame-snuffer tab comprises a width reduction, and wherein said reservoir aperture is sized to frictionally admit said rotating flame-snuffer tab, and to rotatably admit said rotating flame-snuffer tab-width reduction.

* * * * *